US006057784A

United States Patent [19]

Schaaf et al.

[11] Patent Number: 6,057,784

[45] Date of Patent: May 2, 2000

[54] APPARATUS AND SYSTEM FOR MAKING AT-BIT MEASUREMENTS WHILE DRILLING

[75] Inventors: Stuart Schaaf, Houston; Jean Seydoux, Sugar Land, both of Tex.; Walter Thain, Marietta, Ga.; Marcus Wernig, Sugar Land; Alain Dorel, Houston, both of Tex.

[73] Assignee: Schlumberger Technology Corporatioin, Sugar Land, Tex.

[21] Appl. No.: 08/921,971

[22] Filed: Sep. 2, 1997

[51] Int. Cl.[7] ..... G01V 3/00

[52] U.S. Cl. ..... 340/854.4; 324/338; 340/853.3; 340/853.6

[58] Field of Search ..... 340/854.6, 854.4, 340/853.3, 853.1, 853.6; 324/338, 339, 340, 341, 342; 175/40; 455/40

[56] References Cited

U.S. PATENT DOCUMENTS

| | | | |
|---|---|---|---|
| 3,967,201 | 6/1976 | Rorden | 340/854.5 |
| 4,363,137 | 12/1982 | Salisbury | 455/40 |
| 4,800,385 | 1/1989 | Yamazaki | 340/854.4 |
| 4,899,112 | 2/1990 | Clark et al. | 324/338 |
| 5,117,927 | 6/1992 | Askew | 175/61 |
| 5,157,605 | 10/1992 | Chandler et al. | 702/7 |
| 5,160,925 | 11/1992 | Dailey et al. | 340/853.3 |
| 5,163,521 | 11/1992 | Pustanyk et al. | 175/40 |
| 5,235,285 | 8/1993 | Clark et al. | 324/342 |
| 5,339,036 | 8/1994 | Clark et al. | 324/338 |
| 5,339,037 | 8/1994 | Bonner et al. | 324/366 |
| 5,359,324 | 10/1994 | Clark et al. | 340/854.3 |
| 5,375,098 | 12/1994 | Malone et al. | 307/83 |
| 5,410,303 | 4/1995 | Comeau et al. | 340/853.3 |
| 5,448,227 | 9/1995 | Orban et al. | 340/854.4 |
| 5,467,832 | 11/1995 | Orban et al. | 175/45 |
| 5,594,343 | 1/1997 | Clark et al. | 329/338 |
| 5,602,541 | 2/1997 | Comeau et al. | 340/853.3 |
| 5,646,611 | 7/1997 | Dailey et al. | 340/853.6 |

FOREIGN PATENT DOCUMENTS

| | | |
|---|---|---|
| 2 292 869 | 3/1996 | United Kingdom . |
| 2 313 393 | 11/1997 | United Kingdom . |
| WO 87/04028 | 7/1987 | WIPO . |
| WO 97/27502 | 7/1997 | WIPO . |

OTHER PUBLICATIONS

Grunzinski et al., "Telemetry Using the Propagation of an Electromagnetic Wave Along a Drill Pipe String", Proceedings, Measurement While Drilling Symposium, Baton Rouge, Louisiana, Feb. 26–27, 1990.

Rubin et al., "Wireless Electromagnetic Borehole Communications a State–of the Art Review", Proceedings, Measurement While Drilling Symposium, Baton Rouge, Louisiana, Feb. 26–27, 1990.

*Primary Examiner*—Michael Horabik
*Assistant Examiner*—Albert K. Wong
*Attorney, Agent, or Firm*—Steven L. Christian; Wayne I. Kanak

[57] ABSTRACT

The system of the present invention includes measurement instrumentation that is located in or near the drill bit and used in a measuring-while-drilling system. The instrumentation can be located in a bit box, an extended sub between the drilling motor assembly and the bit box or in the drill bit. The drill bit is connected directly to the bit box or extended sub. The close proximity of the instruments to the drill bit allows for more reliable and useful measurements of drill bit, drilling and formation conditions. The bit box houses instruments that measure various downhole parameters such as inclination of the borehole, the natural gamma ray emission of the earth formations, the electrical resistivity of the earth formations, and a number of mechanical drilling performance parameters. Sonic or electromagnetic signals representing these measurements are transmitted uphole to a receiver associated with receiving equipment located uphole from the drill bit.

21 Claims, 9 Drawing Sheets

APPARATUS AND SYSTEM FOR MAKING AT-BIT MEASUREMENTS WHILE DRILLING

BACKGROUND OF THE INVENTION

1. Field of the Invention

This invention relates generally to an apparatus and system for making downhole measurements during the drilling of a wellbore. In particular, it relates to an apparatus and system for making downhole measurements at or near the drill bit during directional drilling of a wellbore.

2. Description of the Related Art

In drilling a directional well, it is common to use a bottom hole drilling assembly (BHA) that is attached to a drill collar as part of the drill string. This BHA typically includes (from top down), a drilling motor assembly, a drive shaft system including a bit box, and a drill bit. In addition to the motor, the drilling motor assembly includes a bent housing assembly which has a small bend angle in the lower portion of the BHA. This angle causes the borehole being drilled to curve and gradually establish a new borehole inclination and/or azimuth. During the drilling of a borehole, if the drill string is not rotated, but merely slides downward as the drill bit is being driven by only the motor, the inclination and/or the azimuth of the borehole will gradually change due to the bend angle. Depending upon the "tool face" angle, that is, the angle at which the bit is pointing relative to the high side of the borehole, the borehole can be made to curve at a given azimuth or inclination. If however, the rotation of the drill string is superimposed over that of the output shaft of the motor, the bend point will simply travel around the axis of the borehole so that the bit normally will drill straight ahead at whatever inclination and azimuth have been previously established. The type of drilling motor that is provided with a bent housing is normally referred to as a "steerable system". Thus, various combinations of sliding and rotating drilling procedures can be used to control the borehole trajectory in a manner such that eventually the drilling of a borehole will proceed to a targeted formation. Stabilizers, a bent sub, and a "kick-pad" also can be used to control the angle build rate in sliding drilling, or to ensure the stability of the hole trajectory in the rotating mode.

Referring initially to the configuration of FIG. 1, a drill string 10 generally includes kelly 8, lengths of drill pipe 11 and drill collars 12 as shown suspended in a borehole 13 that is drilled through an earth formation 9. A drill bit 14 at the lower end of the drill string is rotated by the drive shaft 15 connected to the drilling motor assembly 16. This motor is powered by drilling mud circulated down through the bore of the drill string 10 and back up to the surface via the borehole annulus 13*a*. The motor assembly 16 includes a power section (rotor/stator or turbine) that drives the drill bit and a bent housing 17 that establishes a small bend angle at its bend point which causes the borehole 13 to curve in the plane of the bend angle and gradually establish a new borehole inclination. As noted above, if rotation of the drill string 10 is superimposed over the rotation of the drive shaft 15, the borehole 13 will be drilled straight ahead as the bend point merely orbits about the axis of the borehole. The bent housing can be a fixed angle device, or it can be a surface adjustable assembly. The bent housing also can be a downhole adjustable assembly as disclosed in U.S. Pat. No. 5,117,927 which is incorporated herein by reference. Alternately, the motor assembly 16 can include a straight housing and can be used in association with a bent sub well known in the art and located in the drill string above the motor assembly 16 to provide the bend angle.

Above the motor in this drill string is a conventional measurement while drilling (MWD) tool 18 which has sensors that measure various downhole parameters. Drilling, drill bit and earth formation parameters are the types of parameters measured by the MWD system. Drilling parameters include the direction and inclination (D&I) of the BHA. Drill bit parameters include measurements such as weight on bit (WOB), torque on bit and drive shaft speed. Formation parameters include measurements such as natural gamma ray emission, resistivity of the formations and other parameters that characterize the formation. Measurement signals, representative of these downhole parameters and characteristics, taken by the MWD system are telemetered to the surface by transmitters in real time or recorded in memory for use when the BHA is brought back to the surface.

As shown in FIG. 1, when an MWD tool 18, such as the one disclosed in commonly-assigned U.S. Pat. No. 5,375,098, is used in combination with a drilling motor 16, the MWD tool 18 is located above the motor and a substantial distance from the drill bit. Including the length of a non-magnetic spacer collar and other components that typically are connected between the MWD tool and the motor, the MWD tool may be positioned as much as 20 to 40 feet above the drill bit. These substantial distances between the MWD sensors in the MWD tool and the drill bit mean that the MWD tool's measurements of the downhole conditions, related to drilling and the drill bit at a particular drill bit location, are made a substantial time after the drill bit has passed that location. Therefore, if there is a need to adjust the borehole trajectory based on information from the MWD sensors, the drill bit will have already traveled some additional distance before the need to adjust is apparent. Adjustment of the borehole trajectory under these circumstances can be a difficult and costly task. Although such large distances between the drill bit and the measurement sensors can be tolerated for some drilling applications, there is a growing desire, especially when drilling directional wells, to make the measurements as close to the drill bit as possible.

Two main drilling parameters, the drill bit direction and inclination are typically calculated by extrapolation of the direction and inclination measurements from the MWD tool to the bit position, assuming a rigid BHA and drill pipe system. This extrapolation method results in substantial error in the borehole inclination at the bit especially when drilling smaller diameter holes (less than 6 inches) and when drilling short radius and re-entry wells.

Another area of directional drilling that requires very accurate control over the borehole trajectory is "extended reach" drilling applications. These applications require careful monitoring and control in order to ensure that a borehole enters a target formation at the planned location. In addition to entering a formation at a predetermined location, it is often necessary to maintain the borehole drilling horizontally in the formation. It is also desirable for a borehole to be extended along a path that optimizes the production of oil, rather than water which is found in lower portions of a formation, or gas found in the upper portion of a formation.

In addition to making downhole measurements which enable accurate control over borehole trajectory, such as the inclination of the borehole near the bit, it is also highly desirable to make measurements of certain properties of the earth formations through which the borehole passes. These measurements are particularly desirable where such properties can be used in connection with borehole trajectory control. For example, identifying a specific layer of the formation such as a layer of shale having properties that are known from logs of previously drilled wells, and which is known to lie a certain distance above the target formation, can be used in selecting where to begin curving the borehole to insure that a certain radius of curvature will indeed place the borehole within the targeted formation. A shale formation marker, for example, can generally be detected by its relatively high level of natural radioactivity, while a marker sandstone formation having a high salt water saturation can be detected by its relatively low electrical resistivity. Once the borehole has been curved so that it extends generally horizontally within the target formation, these same measurements can be used to determine whether the borehole is being drilled too high or too low in the formation. This determination can be based on the fact that a high gamma ray measurement can be interpreted to mean that the hole is approaching the top of the formation where a shale lies, and a low resistivity reading can be interpreted to mean that the borehole is near the bottom of the formation where the pore spaces typically are saturated with water. However, as with D&I measurements, sensors that measure formation characteristics are located at large distances from the drill bit.

One approach, by which the problems associated with the distance of the D&I measurements, borehole trajectory measurements and other tool measurements from the drill bit can be alleviated, is to bring the measuring sensors closer to the drill bit by locating sensors in the drill string section below the drilling motor. However, since the lower section of the drill string is typically crowded with a large number of components such as a drilling motor power section, bent housing, bearing assemblies and one or more stabilizers, the inclusion of measuring instruments near the bit requires the addressing of several major problems that would be created by positioning measuring instruments near the drill bit. For example, there is the major problem associated with telemetering signals that are representative of such downhole measurements uphole, through or around the motor assembly, in a practical and reliable way.

A concept for moving the sensors closer to the drill bit was implemented in Orban et. al, U.S. Pat. No. 5,448,227. This patent is directed to a sensor sub or assembly that is located in the drill string at the bottom of the motor assembly, and which includes various transducers and other means for measuring parameters such as inclination of the borehole, the natural gamma ray emission and electrical resistivity of the formations, and variables related to the performance of the drilling motor. Signals representative of such measurements are telemetered uphole, through the wall of the drill string or through the formation, a relatively short distance to a receiver system that supplies corresponding signals to the MWD tool located above the drilling motor. The receiver system can either be connected to the MWD tool or be a part of the MWD tool. The MWD tool then relays the information to the surface where it is detected and decoded substantially in real time. Although the techniques of this patent make substantial progress in moving sensors closer to the drill bit and overcoming some of the major telemetry concerns, the sensors are still approximately 6 to 10 feet from the drill bit. In addition, the sensors are still located in the motor assembly and the integration of these sensors into the motor assembly can be a complicated process.

A technique that attempts to address the problem of telemetering the measured signals uphole around the motor assembly to the MWD tool uses an electromagnetic transmission scheme to transmit measurements from behind the drill bit. In this system, a fixed frequency current signal is induced through the drill collar by a toroidal coil transmitter. As a result, the current flows through the drill string to the receiver with a return path through the formation. The propagation mode is known as a Transverse Magnetic (TM) mode. In this propagation mode, transmission is unreliable in extremely resistive formations, in formations with very resistive layers alternating with conductive layers, and in oil-based mud with poor bit contact with the formation.

Therefore, there still remains a need for a system that can improve the accuracy of bit measurements by placing sensors at the drill bit and reliably transmitting these signals uphole to MWD equipment for transmission to the earth's surface.

As earlier stated there can be a substantial distance between the drilling motor and the drill bit. This distance is caused by several pieces of equipment that are necessary for the drilling operation. One piece of equipment is the shaft used to connect the motor rotor to the drill bit. The motor rotates the shaft which rotates the drill bit during drilling. The drill bit is connected to the shaft via a bit box. The bit box is a metal holding device that fits into the bowl of a rotary table and is used to screw the bit to (make up) or unscrew (break out) the bit from the drill string by rotating the drill string. The bit box is sized according to the size of the drill bit. In addition, the bit box has the internal capacity to contain equipment.

FIG. 2 illustrates a conventional drilling motor system. A bit box 19 at the bottom portion of the drive shaft 15 connects a drill bit 14 to the drive shaft 15. The drive shaft 15 is also connected to the drilling motor power section 16 via the transmission assembly 16*a* and the bearing section 20. The shaft channel 15*a* is the means through which fluid flows to the drill bit during the drilling process. The fluid also carries formation cuttings from the drill bit to the surface. In the drilling system of FIG. 2, no instrumentation is located in or near the bit box 19 or drill bit 14. The closest that the instruments would be to the drill bit would be in the lower portion of the motor power section 16 as described in U.S. Pat. No. 5,448,227 or in the MWD tool 18. As previously stated, the sensor location is still approximately 6 to 10 feet from the drill bit. The positioning of measurement instrumentation in the bit box would substantially reduce the distance from the drill bit to the measurement instrumentation. This reduced distance would provide an earlier reading of the drilling conditions at a particular drilling location. The earlier reading will result in an earlier response by the driller to the received measurement information when a response is necessary or desired.

In view of the above, it is a general object of the present invention to provide a more accurate determination of the detected drilling, drill bit and earth formation parameters and characteristics for transmission to uphole equipment during the drilling of a borehole.

Another object of the present invention is to provide improved control of borehole trajectory during the drilling of wells (in particular, short-radius, re-entry and horizontal wells).

A third object of the present invention is to provide a system for making borehole measurements at the actual point of the formation drilling.

A fourth object of the present invention is to provide an instrumented drill bit that can perform drilling, drill bit and formation measurements at the drill bit location during the drilling of a well.

SUMMARY OF THE INVENTION

The present invention is an apparatus and system for making measurements at the drill bit using sensors in the bit box attached directly to the bit. Sensor measurements are transmitted via wireless telemetry to a receiver located in a conventional MWD tool.

The bit box of the present invention is an extended version of a standard bit box that allows for the placement of instruments (for example one axis accelerometer) in the bit box for making measurements during drilling. A transmitter antenna located in the bit box provides wireless telemetry from the bit box to a receiver located above the drilling motor and usually in the MWD tool. The transmitter and receiver mentioned herein are both capable of transmitting and receiving data. The transmitter antenna is shielded to protect the antenna from borehole elements and conditions. The bit box instrumentation is powered by batteries in the bit box and controlled by electronic components. All system components with the exception of the accelerometer are located in an annular fashion on the bit box periphery and are protected by a pressure shield.

Another implementation of the invention packages the same measuring instruments in a separate sub that attaches to the bit box. Because of the addition of the extended bit box or extended sub, wear on the bearings is increased. To reduce this wear, both implementations may include a near bit stabilizer. A near bit stabilizer reduces wear on the bearings by moving the stabilization point closer to the drill bit. Except for the extended sub device, the implementation of the second embodiment is the same as the first embodiment. Although the extended sub embodiment may be slightly longer than the extended bit box embodiment, the extended sub may be more desirable to implement because the extended sub does not require major changes to the existing equipment such as those required to use the extended bit box shown in FIG. 3 The extended bit box has to be modified at its uphole end to connect with the drilling equipment. As shown in FIG. 4, the extended sub can be attached to a standard bit box and the drill bit attached to the extended sub A third implementation of the present invention has the measuring instrumentation placed in the drill bit. In this embodiment, the upper portion of the drill bit is a housing that contains the measuring instruments, the telemetry means and power and control devices. The drill bit housing is connected to the bit box.

The measurements made by the present invention may be transmitted via electromagnetic or sonic frequency pulses. These pulses are demodulated by the receiver coil. This data is typically decoded and subsequently transmitted in real time via mud pulses to the surface. The data that is transmitted includes drilling data (such as bit inclination and bit direction data), drill bit data (such as weight on bit) and formation measurements.

The present invention provides several improvements over other systems. The measurement of inclination at the bit (not necessarily the borehole inclination when the bent sub is present) allows more accurate calculation of the borehole inclination when used with MWD D&I measurements. Measurement of inclination at the bit provides improved control in drilling wells such as short radius, re-entry and horizontal wells. The first embodiment, which consists of an extended bit box, is especially effective in short radius and re-entry applications since it allows a greater build angle. The second embodiment, which consists of an extended sub, is particularly effective in extended reach well applications or where a moderate build angle is required. A benefit of the extended sub embodiment is that there is no requirement for any modifications to the existing drilling motor.

The present invention is not limited to any specific sensor. A three-axis accelerometer may be used to allow full inclination measurements. Other measurements while drilling parameters may also be added. The wireless telemetry can be electromagnetic or acoustic. Other known telemetry systems can be used to transmit the measured data. In addition, the data transmission of this invention is not limited to a wireless transmission application only or to having the transmitter antenna located in the bit box.

DESCRIPTION OF THE PREFERRED EMBODIMENTS

Figure 3:
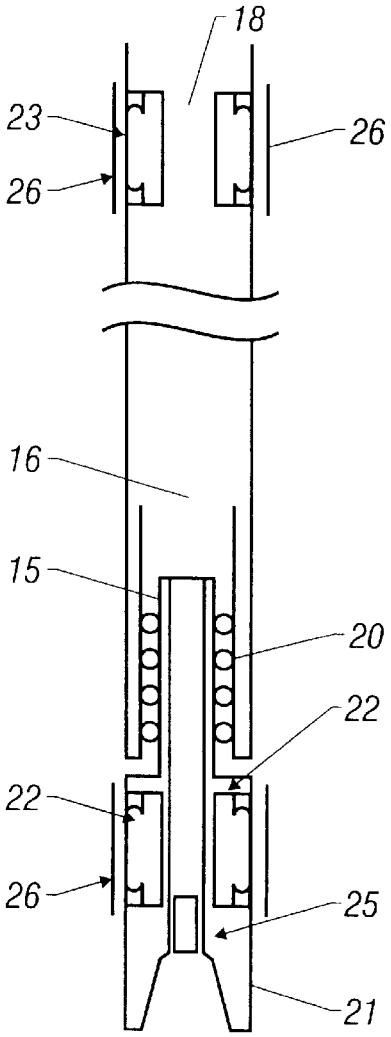
FIG. 3 is a schematic view of the extended bit box embodiment of the present invention.

An extended bit box embodiment of the present invention is shown in FIG. 3. This extended bit box 21 connects the drill bit to drilling motor 16 via drive shaft 15 which passes through bearing section 20. The bit box contains instrumentation 25 to take measurements during drilling of a borehole. The instrumentation can be any arrangement of instruments including accelerometers, magnetometers and formation evaluation instruments. The bit box also contains telemetry means 22 for transmitting the collected data via the earth formation to a receiver 23 in the MWD tool 18. Both transmitter 22 and receiver 23 are protected by shields 26. Data is transmitted around the drilling motor 16 to the receiver.

Figure 4:
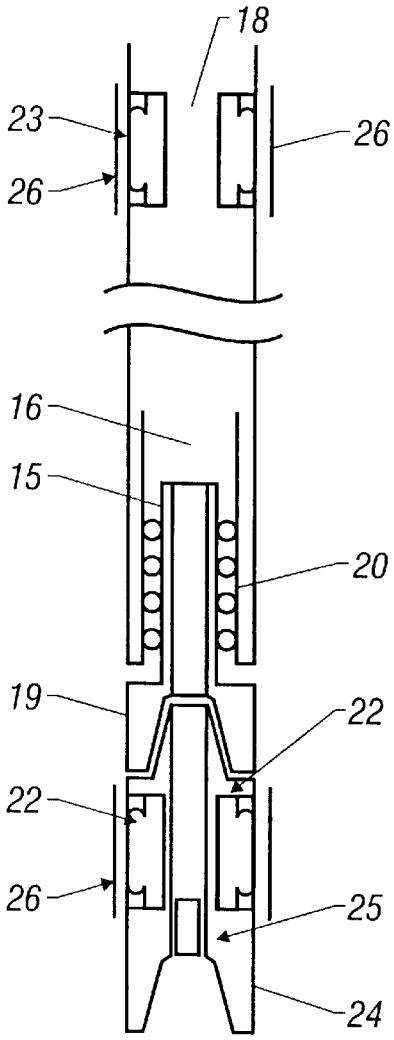
FIG. 4 is a schematic view of the extended sub embodiment of the present invention.

An extended sub embodiment of the invention is shown in FIG. 4. The extended sub 24 connects to a standard bit box 19. The use of an extended sub does not require modifications to the currently used bit box 19 described in FIG. 2. The extended sub contains the measurement instrumentation 25 and a telemetry means 22. (For the purpose of this description, the measurement instrumentation 25 shall be referred to as an accelerometer 25*a*.) These components and others are arranged and operate in a similar manner to the extended bit box embodiment.

Figure 2:
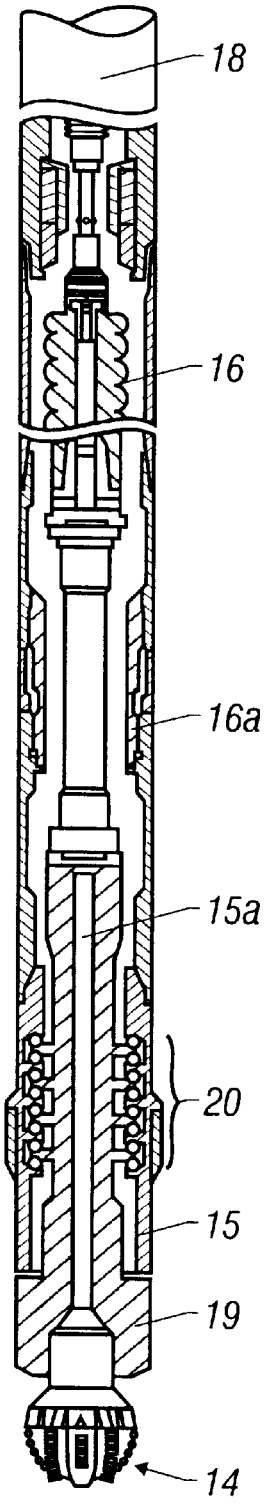
FIG. 2 (PRIOR ART)
FIG. 2 is a cross-section of the lower portion of a drilling assembly without the inclusion of the present invention.
Figure 5:
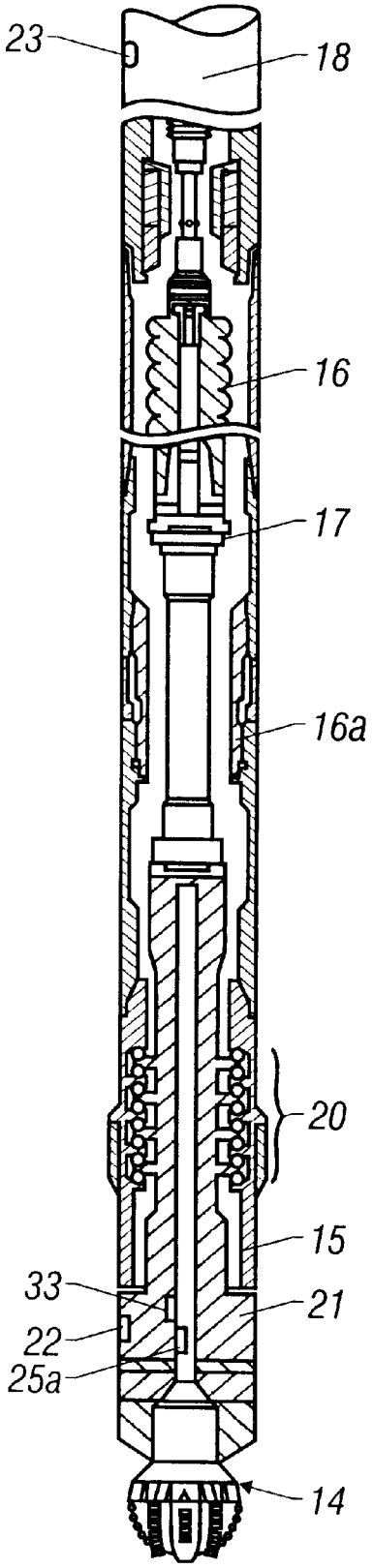
FIG. 5 is a cross-section view of the lower portion of a drilling assembly incorporating the extended bit box embodiment of the present invention.

FIG. 5 is a cross-section view of the present invention modified from FIG. 2. The bit box 19 of FIG. 2 has been extended as shown to form extended bit box 21. Transmitter 22 is now located in the bit box. The bit box now has the capability of containing measurement equipment not located in the bit box in prior tools.

Figure 6:
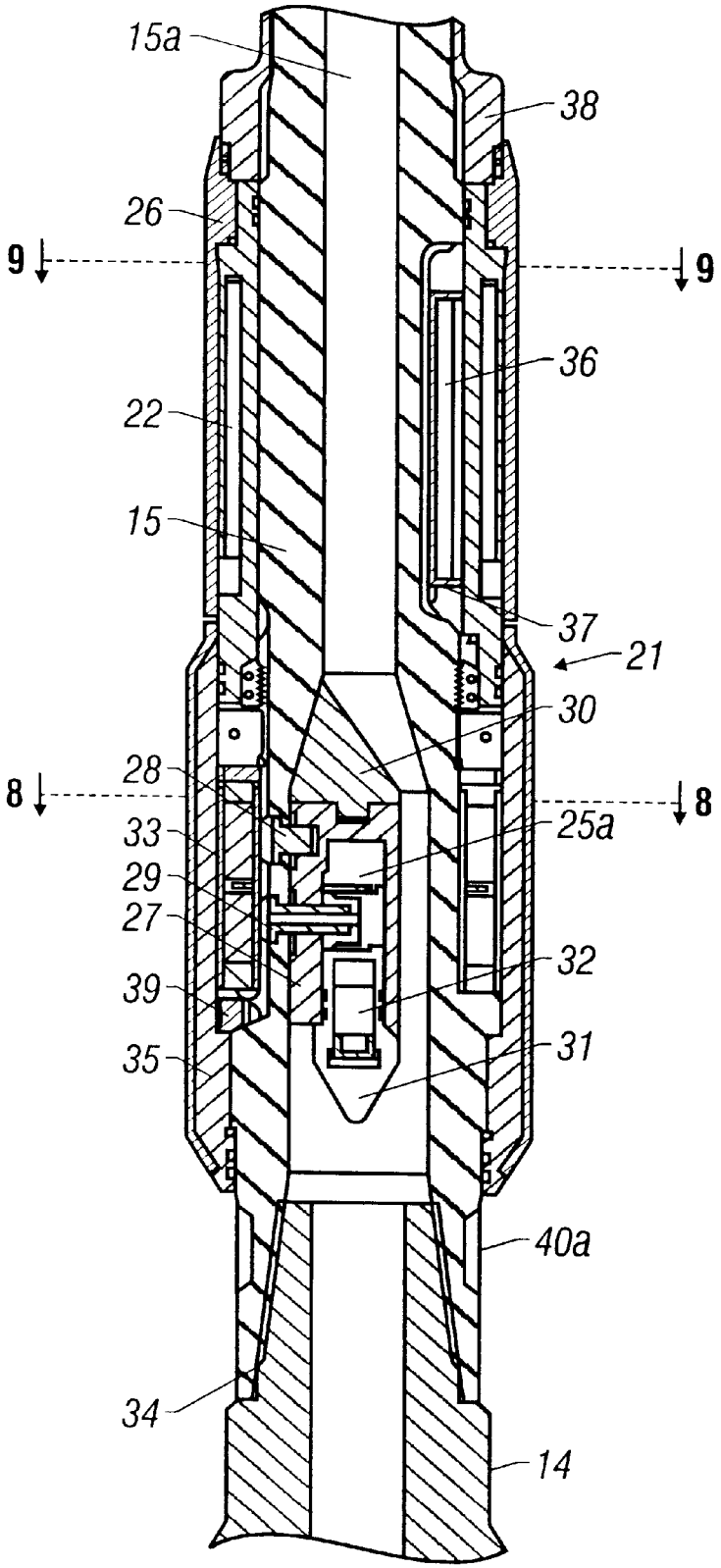
FIG. 6 is a cross-section view of the extended bit box embodiment of the present invention.

The extended bit box embodiment of the present invention is shown in more detail in the cross-section view of FIG. 6. An accelerometer 25*a* for measuring inclination is located within a housing 27 which is made of a light weight and durable metal. The housing is attached to the inner wall of the drive shaft 15 by a bolt 28 and a through hole bolt 29. A wire running through the bolt 29 establishes electrical communication between the accelerometer 25*a* and control circuitry in the electronic boards 36. The housing containing the accelerometer is positioned in the drive shaft channel 15*a*. Since drilling mud flows through the drive shaft channel, the housing 27 will be exposed to the mud. This exposure could lead to the eventual erosion of the housing and the possible exposure of the accelerometer to the mud. Therefore, a flow diverter 30 is bolted to the upper end of the accelerometer housing 27 and diverts the flow of mud around the accelerometer housing. A conical cap 31 is attached to the housing, via threads in the housing, at the drill bit end of the housing. This cap seals that end of the housing to make the accelerometer fully enclosed and protected from the borehole elements. Contained in the accelerometer housing 27 is a filtering circuit 32 that serves to filter detected data. This filtering process is desirable to improve the quality of a signal to be telemetered to a receiver in the MWD tool. Annular batteries 33 are used to provide power to the accelerometer 25*a*, the filtering circuit 32 and the electronic boards 36. A standard API joint 34 is used to attach different drill bits 14 to the extended bit box. A pressure shield 35 encloses the various components of the invention to shield them from borehole pressures. This shield may also serve as a stabilizer. Electronic boards 36, located between the drive shaft 15 and the transmitter 22, control the acquisition and transmission of sensor measurements. These boards contain a microprocessor, an acquisition system for accelerometer data, a transmission powering system and a shock sensor. This electronic circuitry is common in downhole drilling and data acquisition equipment. In this embodiment of the present invention, the electronics are placed on three boards and recessed into the outer wall of the drive shaft 15 so as to maintain the strength and integrity of the shaft wall. Wires connect the boards to enable communication between boards.

A shock sensor 37, which can be an accelerometer, located adjacent to one of the electronic boards 36 provides information about the shock level during the drilling process. The shock measurement helps determine if drilling is occurring. Radial bearings 38 provide for the rotation of the shaft 15 when powered by the drilling motor. A read-out port 39 is provided to allow tool operators to access the electronic boards 36.

As discussed previously, a transmitter 22 has an antenna that transmits signals from the bit box 21 through the formation to a receiver located in or near the MWD tool in the drill string. This transmitter 22 has a protective shield 26 covering it to protect it from the borehole conditions. The antenna and shield will be discussed below.

Figure 7:
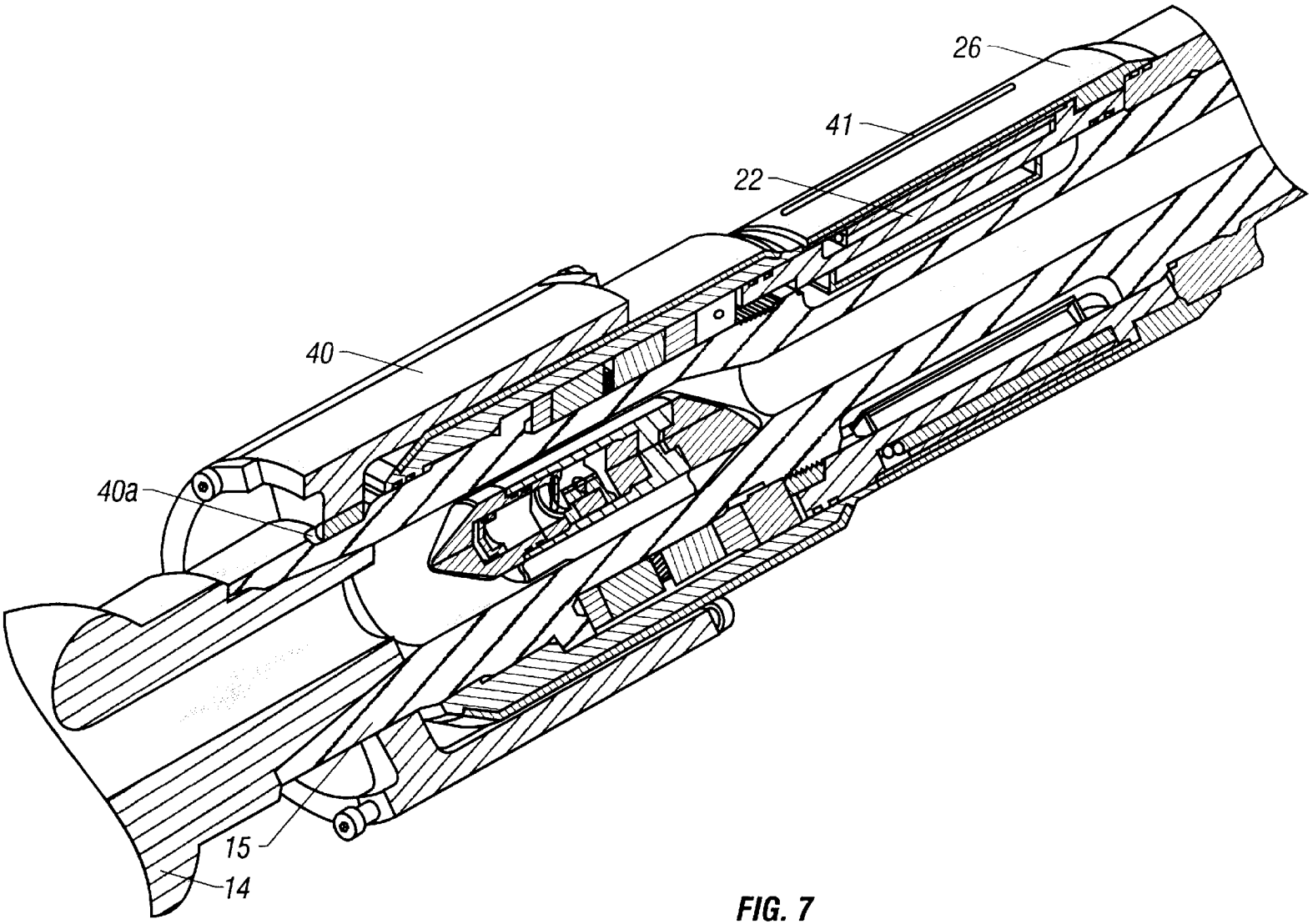
FIG. 7 is an perspective view of the extended bit box embodiment of the present invention.

FIG. 7 gives a perspective view of the present invention and provides a better view of some of the components. As shown, a make-up tool 40 covers a portion of the bit box. The ports 40*a* in the drive shaft 15 serve to anchor the make-up tool 40 on the drive shaft. This make-up tool is used when connecting the drill bit 14 to the bit box. Also shown is the protective shield 26 around the transmitter 22. The shield has slots 41 that are used to enable electromagnetic transmission of the signal.

Figure 8:
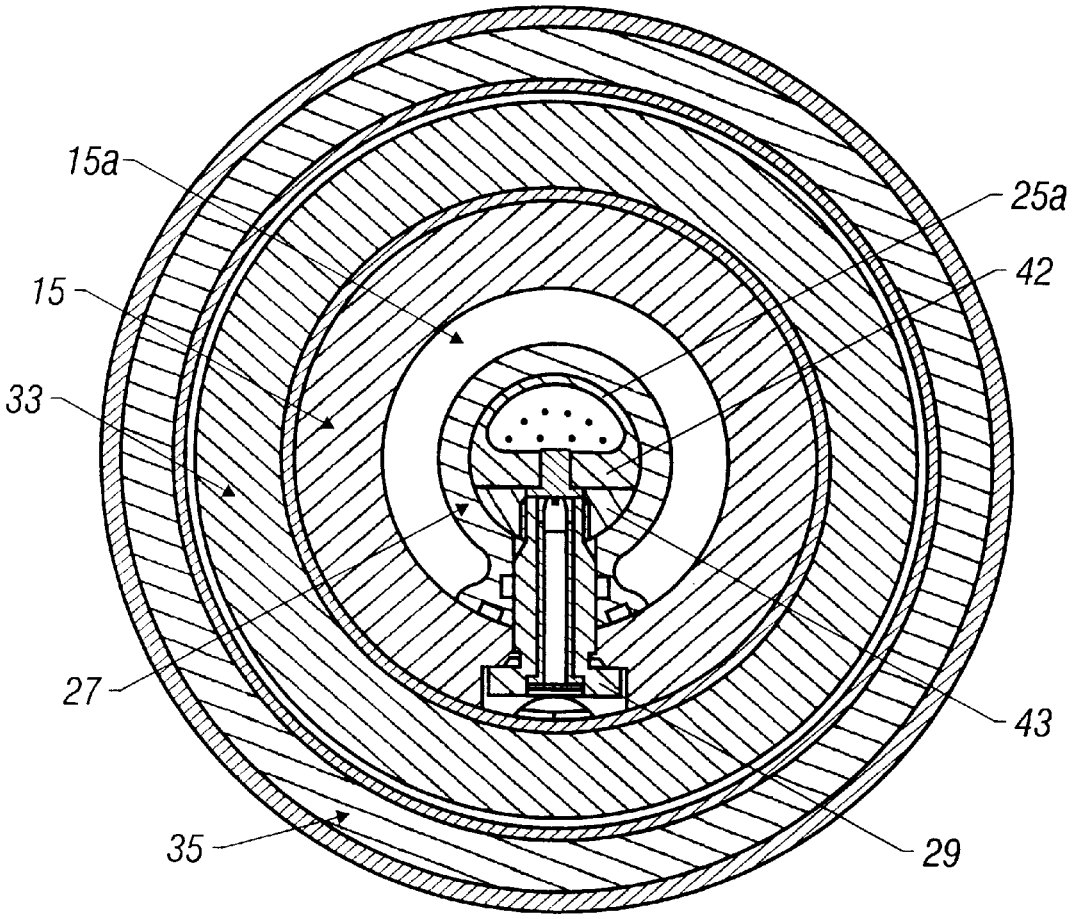
FIG. 8 is a cross-section view of the batteries and the sensing instrumentation mounted inside the channel of the drive shaft.

FIG. 8 provides a cross-section view of the batteries and the sensing instrumentation mounted inside the drive shaft of the present invention. As shown, the measuring instruments are located in the channel 15*a* of the drive shaft 15. The annular batteries 33 surround the drive shaft and supply power to the accelerometer 25*a*. The housing 27 surrounds the accelerometer. The housing is secured to the drive shaft by a bolt 29. A connector 42 attaches the accelerometer 25*a* to the housing 27. A fixture 43 holds the bolt 29. The pressure shield 35 surrounds the annular batteries 33.

Figure 9:
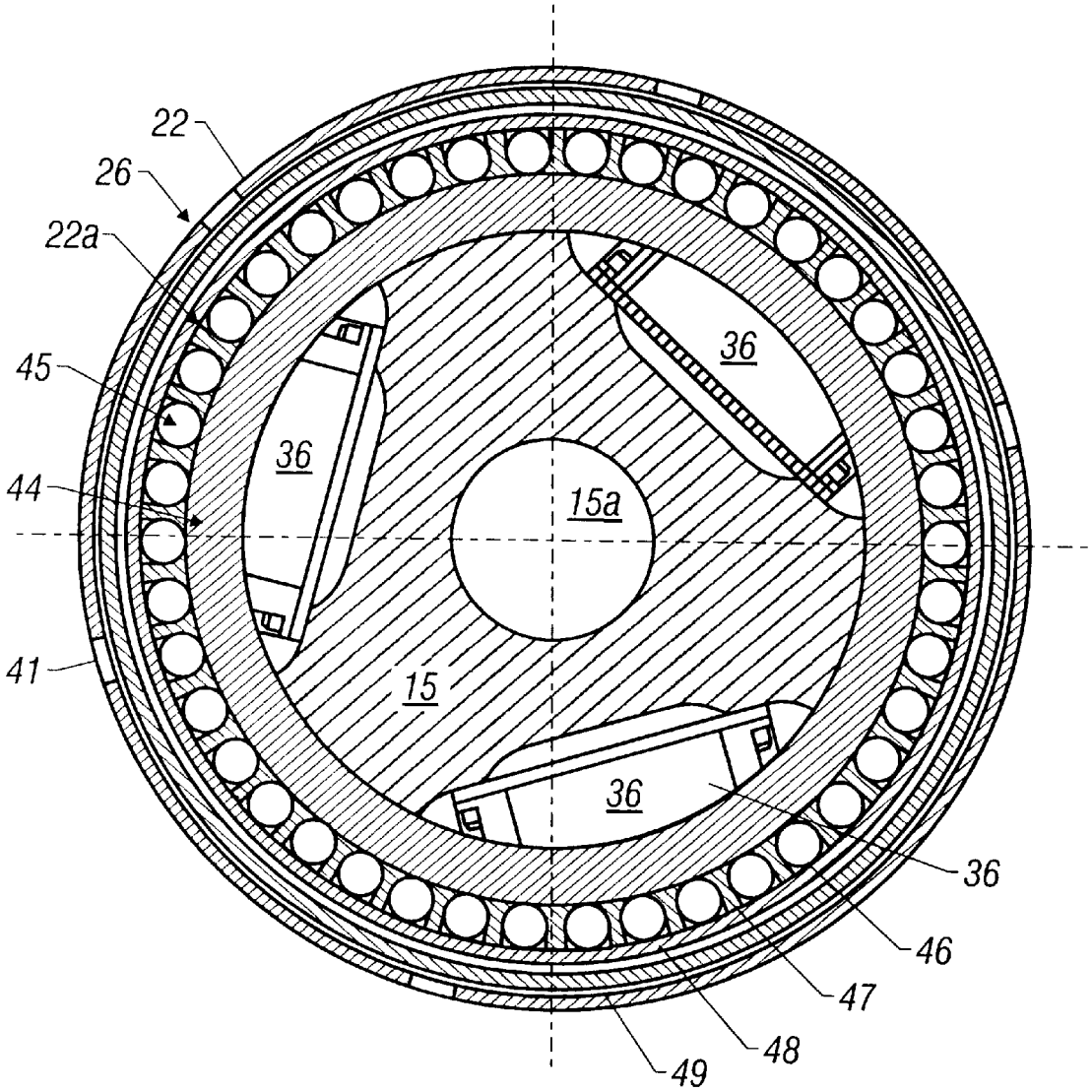
FIG. 9 is a cross-section view of the transmitter and control circuitry of the present invention.

FIG. 9 shows a cross-section view of the transmitter 22 in an extended bit box implementation. A protective shield 26 encloses the antenna 22*a*. This shield has slots 41 that provide for the electro-magnetic transmission of the signals. In this embodiment, the antenna 22*a* is comprised of a pressure tight spindle 44. Ferrite bars 45 are longitudinally embedded in this spindle 44. Around the ferrite bars is wiring in the form of a coil 47. The coil is wrapped by the VITON rubber ring 46 for protection against borehole fluids. An epoxy ring 48 is adjacent the coil and ferrite bars. A slight void 49 exists between the shield 26 and the VITON rubber ring 46 to allow for expansion of the ring 46 during operations. Inside the spindle 44 is the drive shaft 15. The electronic boards 36 are located between the spindle 44 and the drive shaft 15. Also shown is the channel 15a through which the drilling mud flows to the drill bit.

Figure 1:
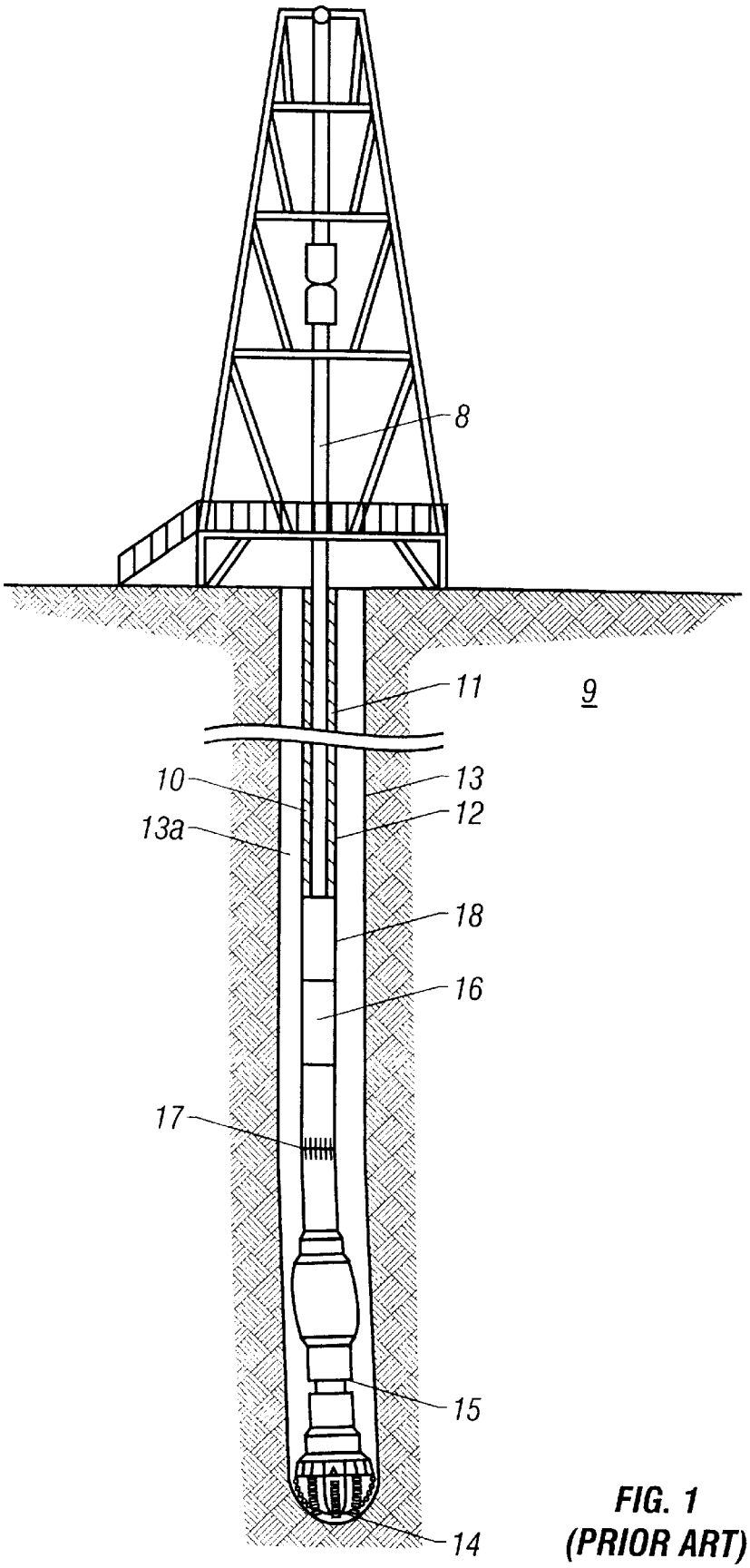
FIG. 1 (PRIOR ART)
FIG. 1 is a schematic view that shows a deviated extended reach borehole with a string of measurement and drilling tools.
Figure 10:
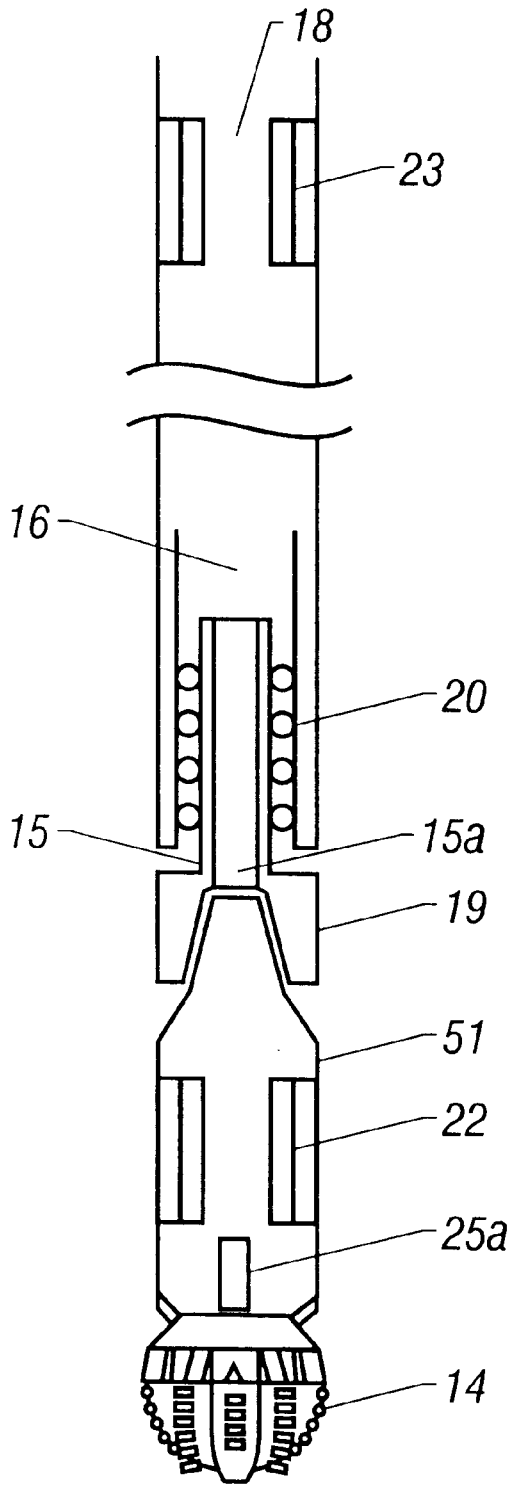
FIG. 10 is a schematic view of the lower portion of a drilling string with an instrumented drill bit.

In another embodiment of the invention, the instrumentation for measuring drilling and drilling tool parameters and formation characteristics is placed directly in the drill bit. This instrumented drill bit system is shown schematically in FIG. 10. The drill bit 14 contains an extension 51 that connects the drill bit to the bit box and drill string. As shown, the extension 51 comprises the upper portion of the drill bit. The accelerometer 25*a* and the transmitter 22 are positioned in the extension in a manner similar to the extended bit box and extended sub embodiments. This instrumented drill bit would fit into a tool such as the one described in FIG. 1. The instrumented drill bit 14 is connected to the bit box 19. As with the other embodiments, the bit box 19 is attached to a drive shaft 15 that is connected to the drilling motor 16 via the bearing section 20. Drilling fluid flows through the drive shaft channel 15*a* to the drill bit. A receiver 23 is located above the drilling motor and usually in an MWD tool 18. It should be mentioned that the drilling motor is not essential to the operation of this embodiment.

As previously mentioned, the earth formation properties measured by the instrumentation in the present invention preferably include natural radioactivity (particularly gamma rays) and electrical resistivity (conductivity) of the formations surrounding the borehole. As with other formation evaluation tools, the measurement instruments must be positioned in the bit box in a manner to allow for proper operation of the instruments and to provide reliable measurement data.

It now will be recognized that new and improved methods and apparatus have been disclosed which meet all the objectives and have all the features and advantages of the present invention. Since certain changes or modifications may be made in the disclosed embodiments without departing from the inventive concepts involved, it is the aim of the appended claims to cover all such changes and modifications falling within the true scope of the present invention.

We claim:

1. A system for making downhole measurements during the drilling of a borehole using a drill bit at the bottom end of a drill string, said system comprising in combination:

a) a drill bit connecting means for connecting said drill bit to said drill string, said connecting means containing one or more instruments for making downhole measurements near said drill bit;

b) a first telemetry means located in said connecting means capable of transmitting signals to and receiving signals from an uphole location; and c) a second telemetry means located uphole from said first telemetry means for communicating with said first telemetry means.

2. The system of claim 1 wherein said first telemetry means transmits signals representative of downhole measurements made by said instruments uphole to said second telemetry means.

3. The system of claim 1 wherein said second telemetry means is located in a measuring while drilling tool located in said drill assembly.

4. The system of claim 1 further comprising a drive shaft attached to said drill bit connecting means.

5. The system of claim 4 wherein at least one of said one or more instruments is an accelerometer capable of measuring borehole inclination.

6. The system of claim 5 wherein said instruments are located in said drive shaft which turns the drill bit and which serves as a channel through which drilling fluid flows.

7. The system of claim 6 further comprising in said shaft an instrument housing having uphole and downhole ends for containing said accelerometer, a diverter attached to the uphole end of said housing for diverting drilling fluid and a cap attached to the downhole end of said housing for sealing said accelerometer from borehole elements.

8. The system of claim 1 further comprising one or more instruments for measuring drill bit parameters.

9. The system of claim 4 further comprising electronic means attached to said drive shaft for powering and controlling said instruments.

10. The apparatus of claim 1 wherein said one or more of said instruments have the capability of making measurements of one or more gamma rays emanating naturally from the formations, electrical resistivity of the formations, inclination of the borehole, direction of the borehole, weight on the drill bit, torque on the drill bit, and drive shaft speed.

11. An apparatus for connecting a drill bit to other downhole drilling equipment in a drilling assembly, said connecting apparatus comprising:

a) a sensor means for taking drilling condition and/or formation measurements during drilling;

b) a housing having one end connected to said drill bit and a second end connected to said downhole drilling equipment, said housing containing said sensor means; and c) a telemetry means contained in said housing for transmitting data to and receiving data from an uphole location.

12. The apparatus of claim 11 further comprising:

d) a means for supplying power to said sensor means and said telemetry means; and e) a control means to control components in said sensor and telemetry means.

13. The apparatus of claim 11 wherein said telemetry means comprises a transmitting and receiving antenna and a shield.

14. The apparatus of claim 11 wherein said sensor means comprises an accelerometer, a housing for containing said accelerometer, a diverter attached to the drilling equipment end of said housing for diverting drilling fluid passing through said apparatus around said housing and a cap attached to the drill bit end of said housing for sealing said accelerometer from borehole elements.

15. A system for use in making downhole measurements during the drilling of a borehole, said system comprising in combination:

a) a drill bit at the bottom end of a drill string;

b) instrumentation contained in said drill bit for measuring drilling and/or drill bit parameters and/or earth formation characteristics;

c) a first telemetry means located in said drill bit for communicating with uphole telemetry equipment; and d) a second telemetry means located in said drill string and uphole from said first telemetry means for communicating with said first telemetry means.

16. The system of claim 15 wherein said first telemetry means transmits signals representative of downhole measurements made by said instrumentation uphole to said second telemetry means.

17. The system of claim 15 wherein said second telemetry means is located in a measuring while drilling tool located in said drill string.

18. The system of claim 15 wherein said drill bit has an extension for connecting said drill bit to said drill string, said extension containing said instrumentation and said first telemetry means.

19. An instrumented drill bit for drilling a borehole and taking measurements during said drilling comprising:

a) a drill bit having an extension for connecting said drill bit to a downhole drill string;

b) instrumentation contained in said extension for measuring drilling and/or drill bit and/or earth formation characteristics; and c) a telemetry means contained in said extension for transmitting and receiving signals from an uphole telemetry means.

20. The instrumented drill bit of claim 19 wherein said extension is a tubular housing.

21. The instrumented drill bit of claim 19 further comprising:

d) a power means for supplying power to said instrumentation and telemetry means; and e) a control means to operate components in said instrumentation and telemetry means.

* * * * *